US007314098B2

(12) United States Patent
Miller

(10) Patent No.: US 7,314,098 B2
(45) Date of Patent: Jan. 1, 2008

(54) APPARATUS FOR DRIVING AND EXTRACTING STAKES

(76) Inventor: Greg Miller, 3601 Lake Arrowhead, Harvey, LA (US) 70058

( * ) Notice: Subject to any disclaimer, the term of this patent is extended or adjusted under 35 U.S.C. 154(b) by 191 days.

(21) Appl. No.: 10/997,263

(22) Filed: Nov. 26, 2004

(65) Prior Publication Data

US 2006/0113456 A1 Jun. 1, 2006

(51) Int. Cl.
*E02D 7/06* (2006.01)
*E02D 7/18* (2006.01)

(52) U.S. Cl. ..... 173/49; 173/21; 173/124

(58) Field of Classification Search ..... 173/49, 173/21, 31, 112, 124, 132, 147; 175/55; 405/231, 232

See application file for complete search history.

(56) References Cited

U.S. PATENT DOCUMENTS 3,437,156 A * 4/1969 Laverty ..... 173/1
3,543,868 A * 12/1970 Drake ..... 173/21
4,060,138 A * 11/1977 Cox et al. ..... 173/49
4,819,740 A 4/1989 Warrington
5,010,710 A * 4/1991 Gray et al. ..... 52/741.14
5,667,021 A 9/1997 Bailey et al.
5,725,329 A 3/1998 Chelminski
6,347,672 B1 2/2002 Reardon
6,386,295 B1 5/2002 Suver
6,776,242 B1 * 8/2004 Cunningham ..... 173/90

* cited by examiner

*Primary Examiner*—Rinaldi I. Rada
*Assistant Examiner*—Nathaniel Chukwurah

(57) ABSTRACT

A hand-held tool having a motor, a vibration mechanism, and a stake-gripping device is disclosed for driving and extracting stakes or posts. The vibration mechanism generally comprises a housing surrounding a pair of geared eccentric plates or geared weighted plates that are rotated by the motor. The stake-gripping device is attached to the vibration mechanism so that vibrations are transferred into a stake or post through the device housing. Internally, the stake-gripping device comprises a pair of toothed plates with at least one of the plates mounted to the housing utilizing springs. The spring mounted plate has an attached wire connected to a handle. As the handle is grasped, the wire pulls the stake-gripping device into the open position allowing placement of a stake or post into the device. When the handle is released, the toothed plate squeezes the stake or post inside the housing.

11 Claims, 6 Drawing Sheets

APPARATUS FOR DRIVING AND EXTRACTING STAKES

FIELD OF THE INVENTION

The present invention relates to a vibratory hand-held tool for mechanically driving and extracting a stake or post into and out of the ground or other support surface.

BACKGROUND OF THE INVENTION

Driving stakes or posts into the ground is required in many circumstances related to the building of foundations, fences, and other applications. The physical act of driving such stakes or posts is typically labor intensive and performed manually by a worker using a hammer or maul. In many circumstances, the numbers of stakes or posts that must be driven into the ground are such that manual placement of the stakes or posts is cost prohibitive and a mechanical means of performing the job is necessary to speed the process. In addition, the work site in which the stakes or posts must be driven may be remote or may not have an adequate power supply, thus the mechanical stake/post driver must be relatively lightweight and self-powered. In response to these concerns, others have disclosed mechanical stake/post drivers.

U.S. Pat. No. 6,347,672 discloses a hammer element configured to strike a stake or post. The hammer element is coupled to a handheld jackhammer via a spindle. The hammer element is housed within a guide assembly that comprises a lower portion to receive the stake/post and an upper portion to receive the spindle.

U.S. Pat. No. 5,806,608 discloses an air-driven post driver that includes a hammer assembly and post receiving assembly. The hammer assembly includes an air-driven piston hammer disposed within a cylinder bore of a cylinder body having an upward thrusting air passageway, which includes a radially oriented upward intake passageway and a longitudinally oriented upward discharge passageway, and a downward thrusting air passageway, which includes a radially oriented downward intake passageway and a longitudinally oriented. downward discharge passageway having a threaded downward discharge port.

U.S. Pat. No. 5,667,021 discloses a stake driver including a frame for supporting a hammer and a stake under the hammer. The hammer is secured upon movable mounts and is raised via a hoist and repeatedly dropped to effect the driving of the stake.

U.S. Pat. No. 5,494,117 discloses a metal fence post driving apparatus formed by a platform rearwardly supported by the three point hitch of a conventional tractor and having a fluid pressure generating unit on the platform driven by the tractor power takeoff. A mast having a top end portion rotatable about its vertical axis pivotally supports a boom intermediate its ends for horizontal and vertical pivoting movement of its respective end portions by a first fluid pressure operated cylinder. A second fluid pressure cylinder pays out and retracts one end portion of the wire line of a block and tackle unit for elevating and lowering a fluid pressure operated reciprocating unit axially disposed on a post top to be driven into the ground.

U.S. Pat. No. 5,107,935 discloses an accessory for ajackhammer comprising a clamping means for gripping the upper end of the stake so that the user can controllably drive the stake into the ground. The accessory includes a stake receiver that has a channel into which the end portion of the stake is inserted and further includes a jaw and clamping means for forcibly retaining the jaw against the inserted stake. The channel includes guide ways that permit it to be used interchangeably with the more common sizes and shapes of stakes.

U.S. Pat. No. 5,088,567 discloses a device having a plurality of guides and a striking mass movable by a hydraulic cylinder. The hydraulic cylinder is arranged with its longitudinal axis outside the path of the center of gravity of the striking mass. The striking mass can comprise a first elastomeric and/or plastic component and a second heavy metal component. Three guides, which can be parallel to the movement path of the center of gravity, are provided for guidance of the striking mass, the striking mass is preferably constructed to be guided at its respective areas.

U.S. Pat. No. 5,819,857 discloses a portable power driven post driver having an inner hollow cylinder open at its upper end and adapted to receive a post through a locking mechanism located at its lower end. The inner cylinder is located within an outer surface of the outer cylinder; the longitudinal axes of the two fluid powered cylinders being in alignment. A common piston rod extends between the two pistons and is attached by a fastening member to the inner cylinder, the fastening member extending through a slot in the outer cylinder. A valve receives compressed fluid, such as compressed air, and cyclically and alternately directs the compressed fluid to the two fluid powered cylinders to alternately raise the outer cylinder above the inner cylinder and to drive the upper cylinder downwardly into post driving contact with the upper end of a post held by the inner cylinder.

U.S. Pat. No. 4,665,994 discloses a portable hand held post driver which is fully operable by a single worker and which uses a fluid powered cylinder to drive posts into the ground. The cylinder raises a balanced driving weight and forces the weight down onto the post. The cylinder is reversed automatically at both the top and bottom of its stroke to automatically repeat the driving strokes so long as the operator holds a hand lever. The post is clamped to the frame of the implement by a clamp having an overcenter control linkage. Before the implement can be operated, a safety-linking pin must be intentionally released by operating a safety lever.

The common feature among all of these prior art devices is that each apparatus employs a striking mass to hammer the stake or post into the ground. However, in the area of pile driving, wherein the members being driven into the ground are much larger and requires significantly more energy, it has been found that when a pile is subjected to intense linear vibration along the axis of the pile, and when the weight of the vibratory driving apparatus is added to the weight of the pile, the rate of penetration is more frequently found to be considerably faster than would be obtained using a hammer-type apparatus.

Furthermore, by employing vibratory forces rather than a hammer-type force, the same hand-held tool used to drive the stake or post into the ground could be used to remove the stake or post after it has been set in place. Hammer-type stake/post drivers are incapable of removing a stake or post from the ground.

U.S. Pat. No. 5,725,329 discloses a linear-type pile driver that is suspended above a pile via a crane. The driver comprises a lifting shaft isolated from but slideably mounted within a piston assembly which is attached to a frame assembly, a cylinder assembly attached a reaction mass, the piston assembly being vibratorily positioned within the cylinder assembly and vibratorily driven by hydraulic fluid at a selectable frequency thereby vibrating the piston/frame assembly.

U.S. Pat. No. 4,819,740 discloses a rotational-type pile driver that is also suspended above a pile via a crane. The vibratory pile driver includes, among other elements, a pair of eccentric weights mounted on shafts for rotation about an axis transversely of the clamped piling for imparting vibratory forces to the piling as the eccentrics are driven in rotation.

These examples of pile drivers, however, are designed for driving and extracting piles, which are typically large timbers or pipes, and cannot be employed for the much smaller scale operation of driving stakes or posts. Thus, it is desirable to have a simple, lightweight, vibratory stake/post driving apparatus that could be used by an individual to efficiently set stakes or posts.

SUMMARY OF THE INVENTION

Accordingly, an apparatus for driving and extracting stakes is provided generally comprising a hand-held tool having a motor, a vibration mechanism, and a stake-gripping device. The motor may be electric or gasoline powered. The disclosed vibration mechanism generally comprises a housing surrounding a pair of geared eccentric plates or geared weighted plates that are rotated by the motor via a motor gear. The stake-gripping device has a housing having an opening at its lower end for receiving a stake or post. The stake-gripping device is fixedly attached to the vibration mechanism so that the vibratory energy created by the vibration mechanism is transferred into a stake or post through the stake gripping device housing. Internally, the stake-gripping device comprises a pair of toothed plates that are mounted on the internal surface of the housing. At least one of the toothed plates is mounted to the housing utilizing springs. The spring mounted plate is installed with an attached wire connected to a handle which acts similar to a throttle cable. As the handle is grasped the wire pulls the stake-gripping device into the open position. This allows easy placement of a stake or post into the stake-gripping device. When the handle is released, the attached wire allows the toothed plate to squeeze the stake or post inside the stake-gripping device housing.

PREFERRED EMBODIMENTS OF THE INVENTION

In the following detailed description of the preferred embodiments, reference is made to the accompanying drawings, which form a part hereof, and in which are shown by way of illustration specific embodiments in which the invention may be practiced. It is to be understood that other embodiments may be utilized and structural changes may be made without departing from the scope of the present invention.

Figure 1:
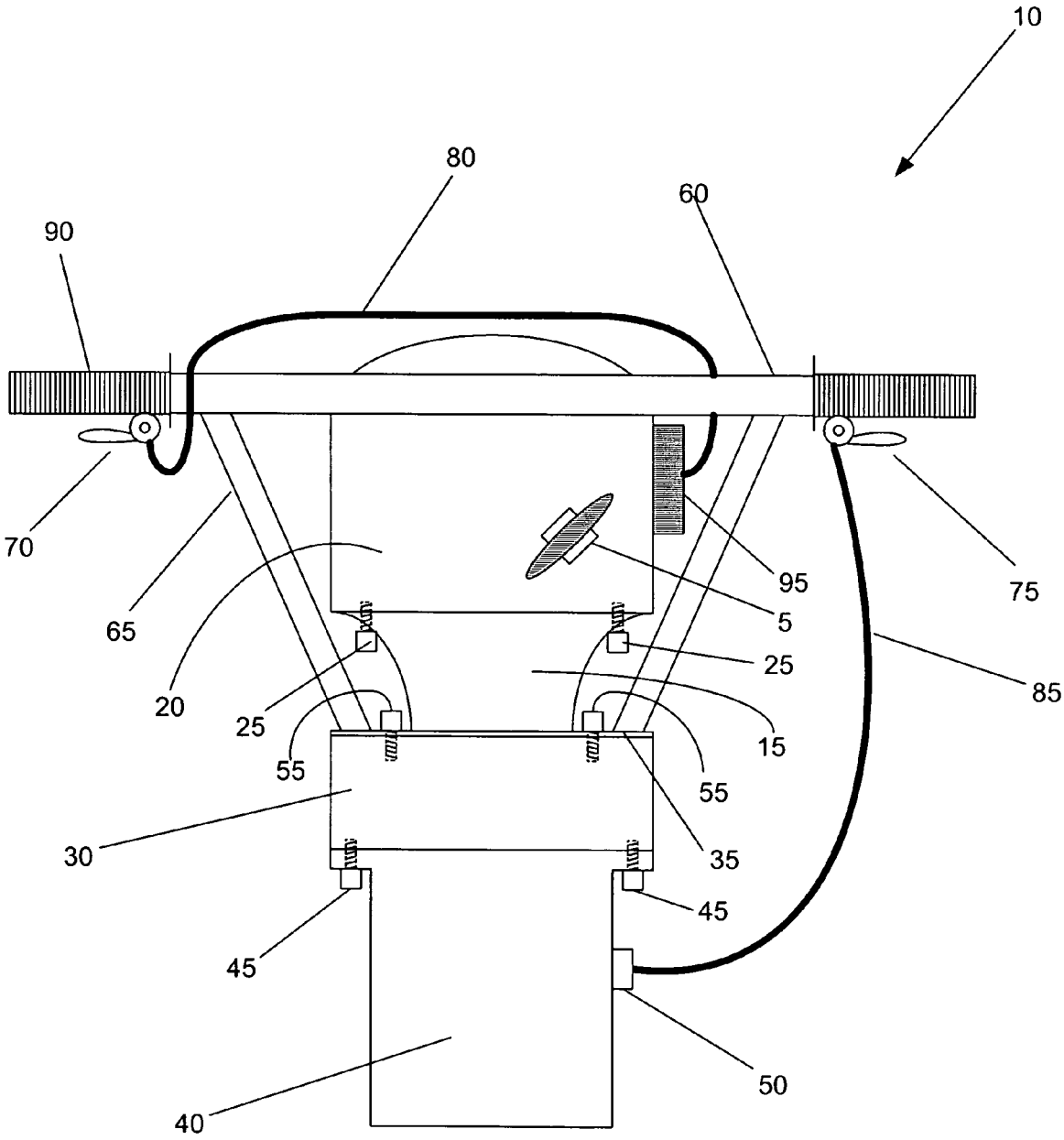
FIG. 1 is a side perspective of one preferred embodiment of the present invention.

One preferred embodiment of the present invention is illustrated in FIG. 1. The stake driving and extracting apparatus 10 generally comprises motor 20 placed in positioned such that the shaft (not shown) is aligned in a vertical direction. Motor 20 is shown as a gasoline powered engine having a pull cord 5 to start the engine. While the size of motor 20 can be chosen for a given application, a 2-stroke 25-75 cubic centimeter engine should suffice for most stake driving applications. A larger engine can be installed for large stakes and/or posts. Motor 20 could also be a standard squirrel cage induction motor powered by an electrical source.

Shaft housing 15 is attached to the bottom end of motor 20. Housing 15 serves to protect the shaft extending from motor 20 and also to support the weight of the motor 20. The shaft housing 15 can be manufactured of any suitable lightweight material, such as hard plastic or aluminum, and is attached to motor 20 by bolts 25. The bottom end of shaft housing 15 is attached to vibrating mechanism 30 via plate 35. Plate 35 is a substantially flat plate having an opening for the passage of the shaft from motor 20. Bolts 55 are inserted through a lip on the bottom of shaft housing 15 which secures housing 15 to plate 35 and connects shaft housing 15 to vibrating mechanism 30. Alternatively, plate 35 can be formed as an integral part of shaft housing 15.

Vibrating mechanism 30 is disposed above stake-gripping device 40, both of which are described in more detail below. Vibrating mechanism 30 is attached to stake-gripping device 40 via bolts 45. After the motor 20, shaft housing 15, vibrating mechanism 30 and stake-gripping device 40 are bolted together, the parts form a substantially rigid device.

In order to operate the disclosed apparatus, the motor 20, shaft housing 15, vibrating mechanism 30 and stake-gripping device 40 are suspended from frame 60. Frame 60 may be constructed of any suitable lightweight material, such as hard plastic or aluminum. The upper portion of frame 60 surrounds motor 20 and is connected to plate 35 by a plurality support members 65. Frame 60 also includes a pair of opposing handles 90. Handles 90 may be fitted with rubber grips. With this configuration, a user may grasp handles 90 and hold the entire apparatus as it is suspended from frame 60.

The embodiment illustrated in FIG. 1 also comprises a throttle 70 and a gripping mechanism 75, each mounted upon a separate handle 90. Throttle 70 is connected to motor controller 95 via a standard throttle cable 80. By squeezing throttle 70 against handle 90, the user can control the speed of motor 20. Gripping mechanism 75, which is attached to stake-gripping device 40 via cable 85 operates in a similar fashion to throttling cable 80. The user squeezes gripping mechanism 75 against handle 90 in order to insert a stake or post into stake-gripping device 40. Once a stake or post is inserted, the user releases the gripping mechanism 75, which causes stake-gripping device 40 to internally secure the stake or post.

Figure 2:
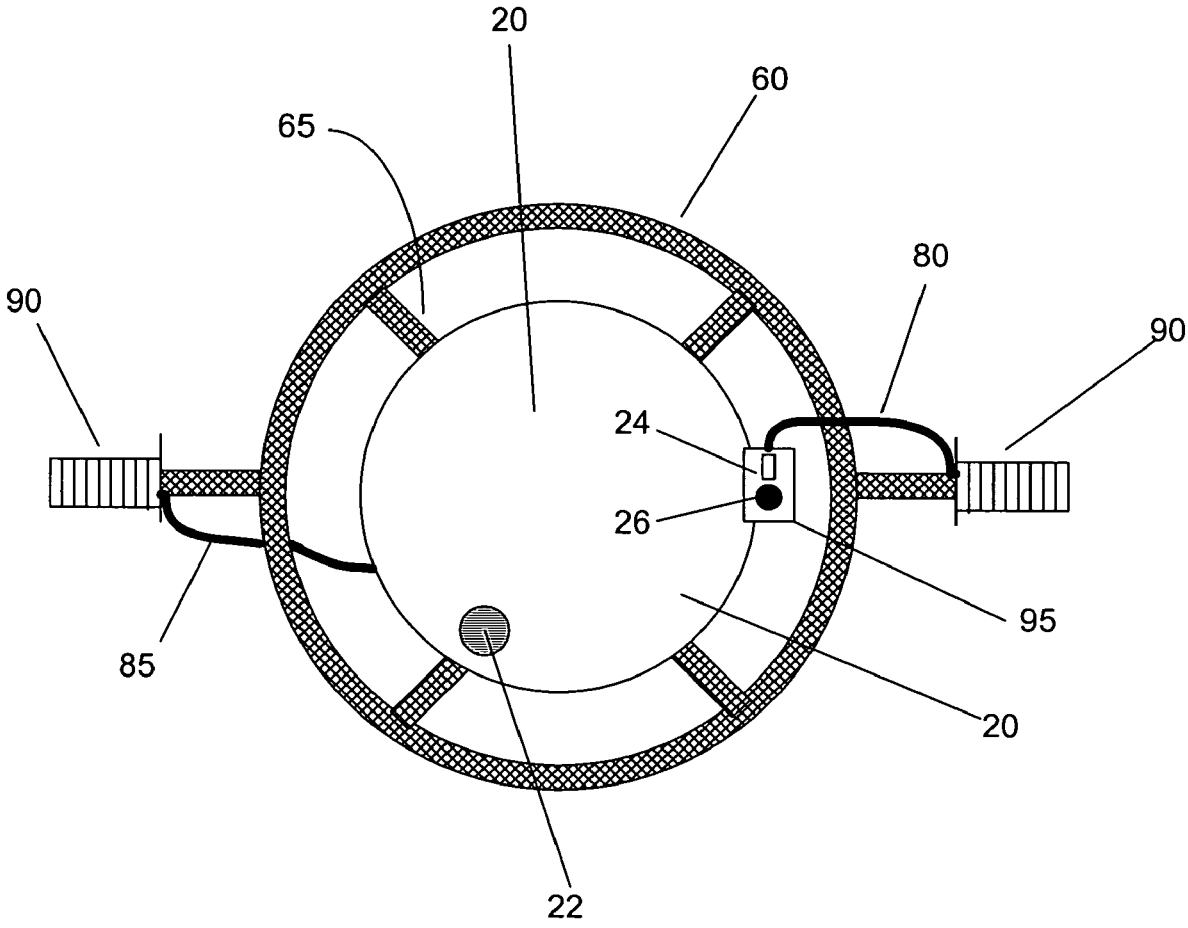
FIG. 2 is an overhead perspective of the preferred embodiment shown in FIG. 1.

FIG. 2 shows the apparatus of FIG. 1 in an overhead perspective. Frame 60 surrounds motor 20 and, as described above, is connected to plate 35 (not shown) by a plurality of support members 65. Motor 20 includes a fuel tank that is filled through port 22 and a motor controller 95. Motor controller 95 contains the necessary components to start and stop motor 20, such as an on/off switch 24, priming bubble 26, and a throttle attached to throttling cable 80. Motor 20 may also include a choke device and any other components that are installed on conventional motors used to operate hand-held power tools.

Figure 3:
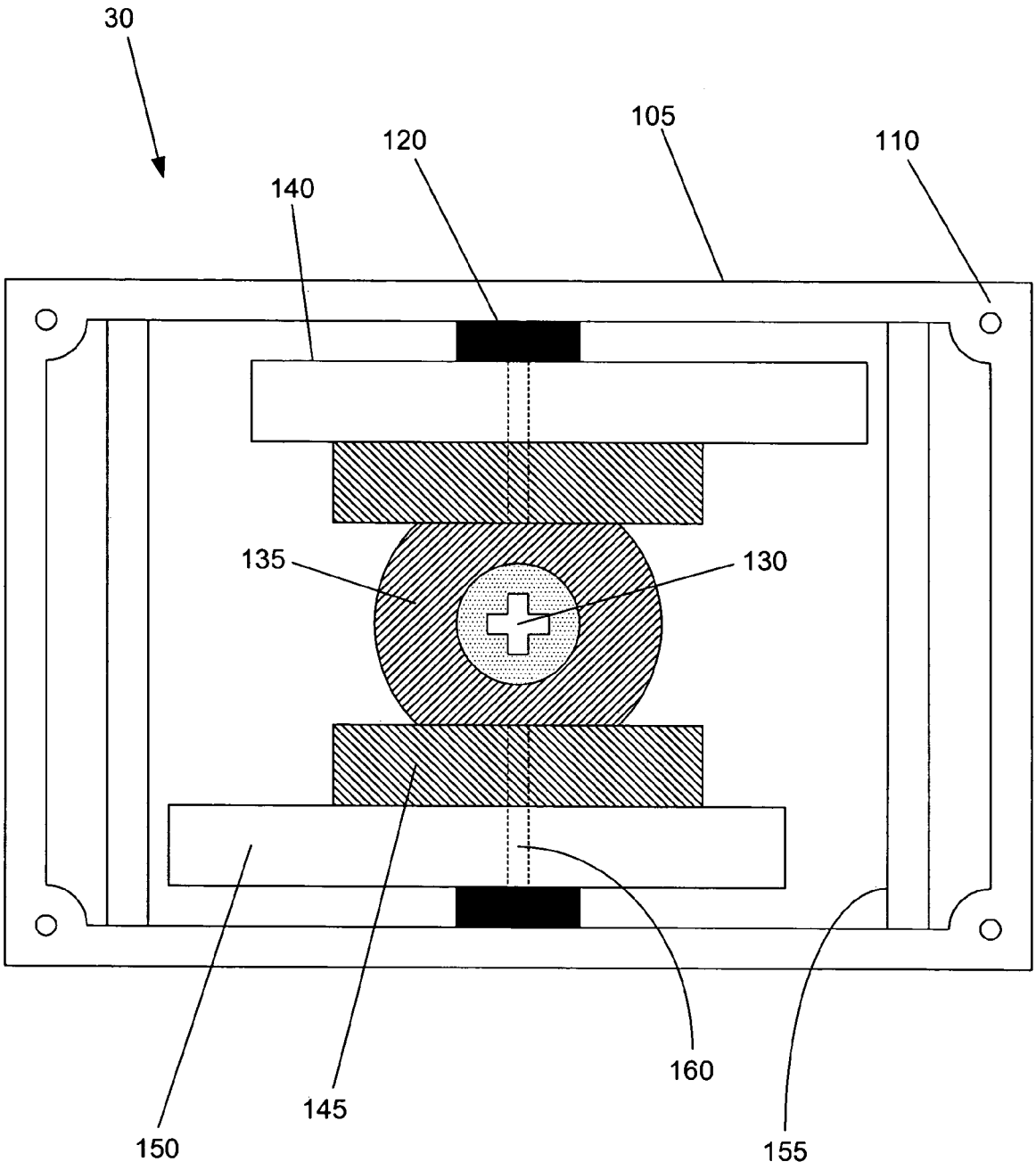
FIG. 3 is an overhead perspective of the vibrating mechanism of one preferred embodiment featuring geared eccentric plates.

One preferred embodiment of vibrating mechanism 30 is illustrated in FIG. 3. The mechanism 30 is shown from an overhead perspective and with plate 35 removed. All of the internal components of vibrating mechanism 30 are housed within housing 105. Housing 105, like the other components of the apparatus, may be constructed of any suitable light-weight material, such as plastic or aluminum. Housing 105 attaches to shaft housing 15 (shown in FIG. 1) via bolts that engage bolt holes 110. Plate 35 is positioned between housing 105 and shaft housing 15 as described above. Housing 105 may be reinforced by cross-member supports 155.

Inside housing 105, the shaft extending from motor 20 terminates within shaft keyway 130, which forms a centralized opening within motor gear 135. While FIG. 3 illustrates a keyway 130 having a cross shape, any conventional method of connecting the shaft to motor gear 135 may be employed. Motor gear 135 is disposed in a perpendicular arrangement with respect to the shaft extending from motor 20 such that as motor 20 turns the shaft, the shaft turns motor gear 20. Also disposed within housing 105 are two geared eccentric plates 140 that are mounted on opposing walls of housing 105. The geared eccentric plates 140 have a geared portion 145 and an eccentric plate portion 150. Geared portion 145 is mechanically coupled via gear teeth to motor gear 135. Thus, as motor gear 135 rotates in its plane (perpendicular to the shaft of motor 20), so do geared eccentric plates 140; however, geared eccentric plates 140 rotate in a plane parallel to the shaft of motor 20. The eccentric plate 150 portions of plates 140, because of their eccentricity, create vibrational energy as they turn. This is because of the imbalance of the center of mass of the geared eccentric plates 140 as the plates rotated around its central axis. As stated above, the geared eccentric plates 140 are mounted on opposing internal walls of housing 105. In order to maximize the amount of vibrational energy created as the eccentric plates rotate, it is preferred to mount plates 140 with each plate's center of mass 180 degrees apart when viewed along the axis of rotation. The vibrational energy is transferred from the mechanical apparatus and into a stake or post that has been attached to the stake-gripping device.

Geared eccentric plates 140 are mounted onto the internal surface of housing 105 by sliding engagement upon shaft 160, which extends outward from the internal wall of housing 105. Bushing 120 separates geared eccentric plates 140 form the internal wall of housing 105 to ensure that geared eccentric plates 140 are allowed to spin freely.

Figure 4:
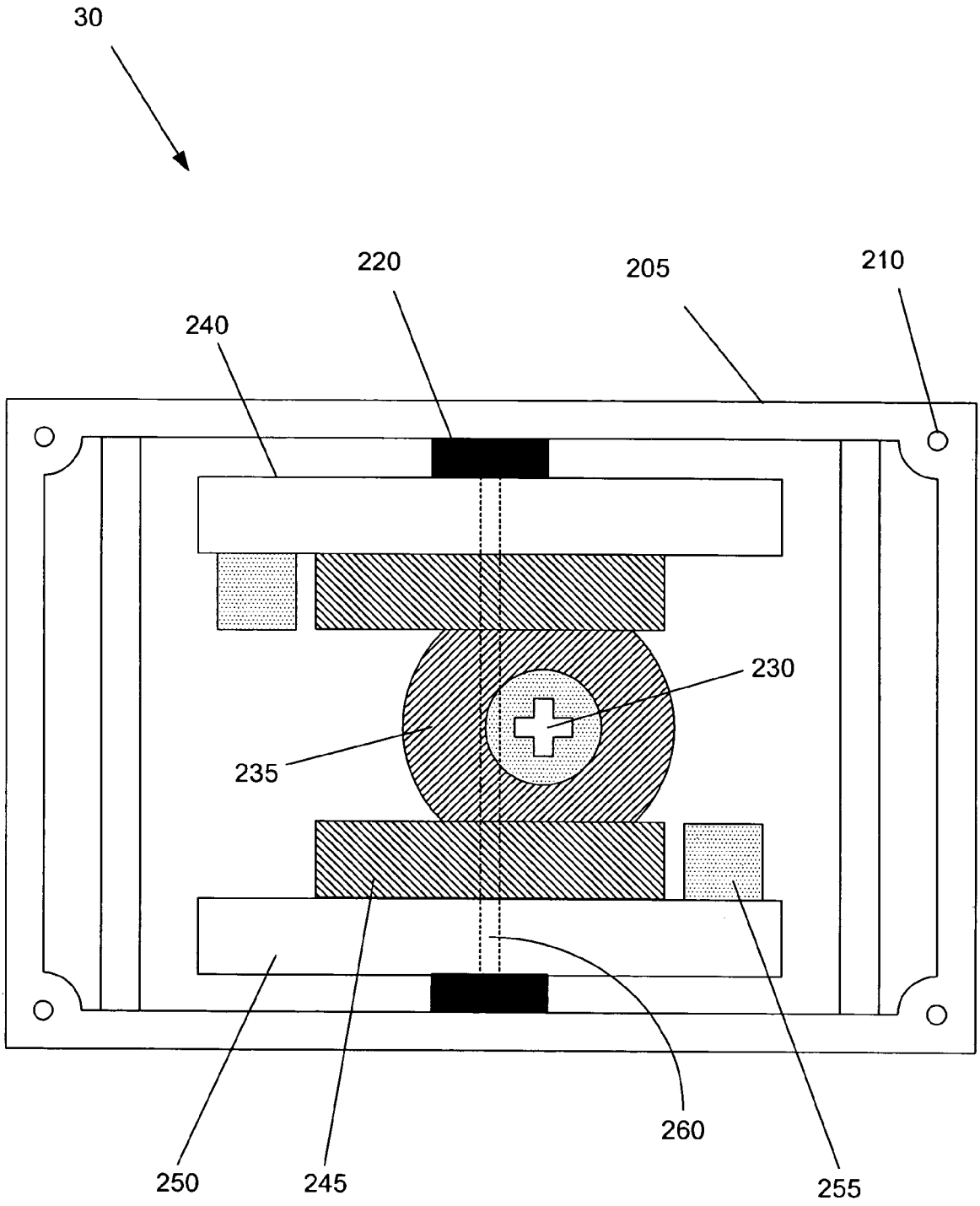
FIG. 4 is an overhead perspective of the vibrating mechanism of another preferred embodiment featuring geared weighted plates.

Another preferred embodiment of vibrating mechanism 30 is illustrated in FIG. 4. Again, the vibrating mechanism 30 is shown from an overhead perspective and with plate 35 removed. The primary difference between the device shown in FIG. 4 as compared to the device shown in FIG. 3 is the replacement of geared eccentric plates with geared weighted plates 240. In addition, the motor gear 235, along with the shaft from motor 20, has been shifted off center to make room for axle 260. Axle 260 is attached to opposing walls of housing 205 and offers more support for geared weighted plates 240.

Geared weighted plates 240, like the geared eccentric plates, have a geared portion 245 that is mechanically coupled via gear teeth to motor gear 235. Plates 240 also have a weighted plate portion 250 that has a weight 255 attached near the outer edge of the weighted plate portion 250. The weight moves the center of mass of the geared weighted plate 240 away form the central axis of rotation such that as the weighted plate 240 rotates it creates vibrational energy. As with the embodiment shown if FIG. 3, the weighted plates 240 should be mounted on axle 260 such that the center of mass of each plate is 180 degrees apart when viewed along the axis of rotation in order to maximize vibrational energy.

Weighted plates 240 are mounted onto the internal surface of housing 205 by sliding engagement upon axle 260, which extends from opposing internal walls of housing 205. Bushing 220 separate weighted plates 140 form the internal wall of housing 205 to ensure that geared weighted plates 240 are allowed to spin freely.

Figure 5:
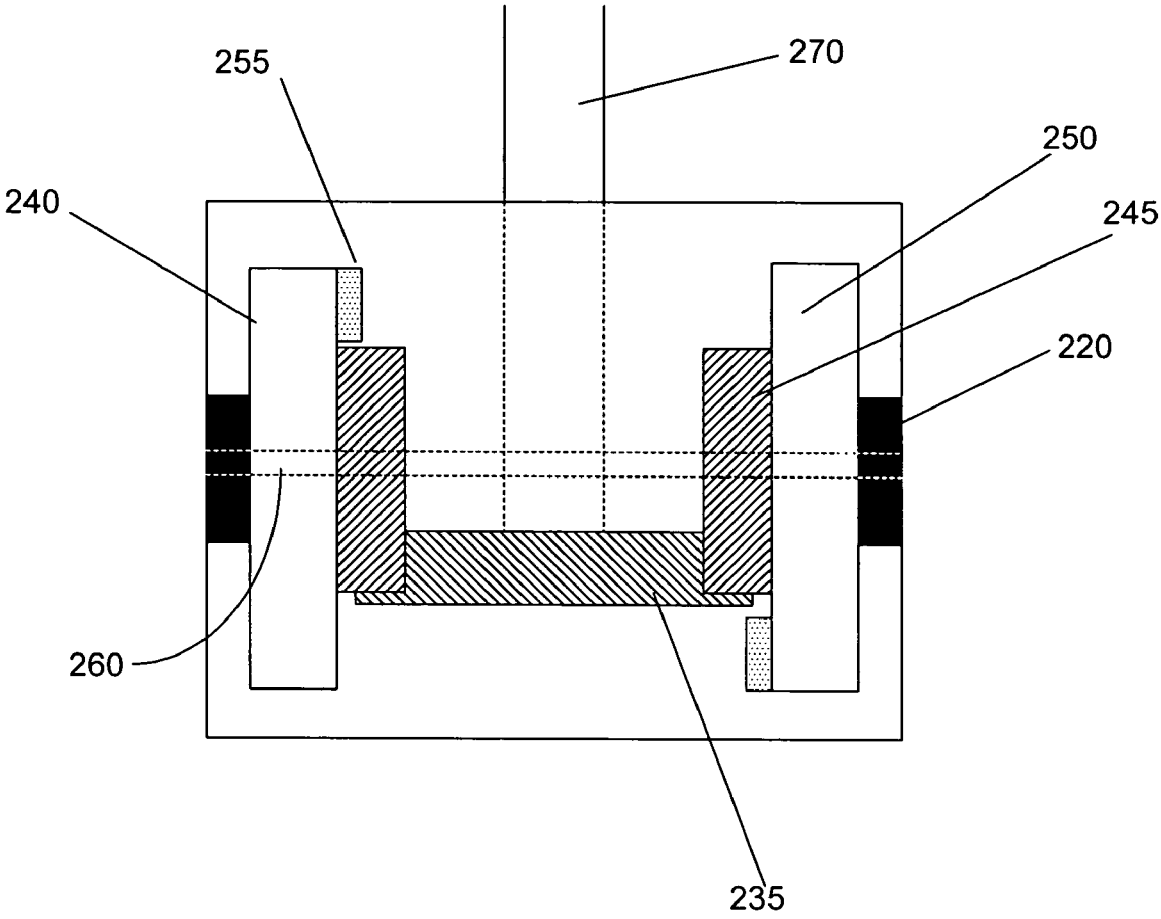
FIG. 5 is a side perspective of the vibrating mechanism of FIG. 4.

FIG. 5 is a side perspective of vibrating mechanism 30. Shaft 270 is shown extending down from motor 20 (not shown). Shaft 270 extends into the keyway of motor gear 235 and rotates the motor gear 235 as the shaft 270 turns. The teeth of motor gear 235 are mechanically engaged with the teeth of the geared portion 245 of the geared weighted plates 240. Thus, as motor gear 235 rotates, so do the geared weighted plates 240. The weighted plates 240 are slidingly positioned onto axle 260 which extends from opposing walls of housing 205. Bushings 220 ensure that plates 240 are allowed to rotate freely.

Figure 6:
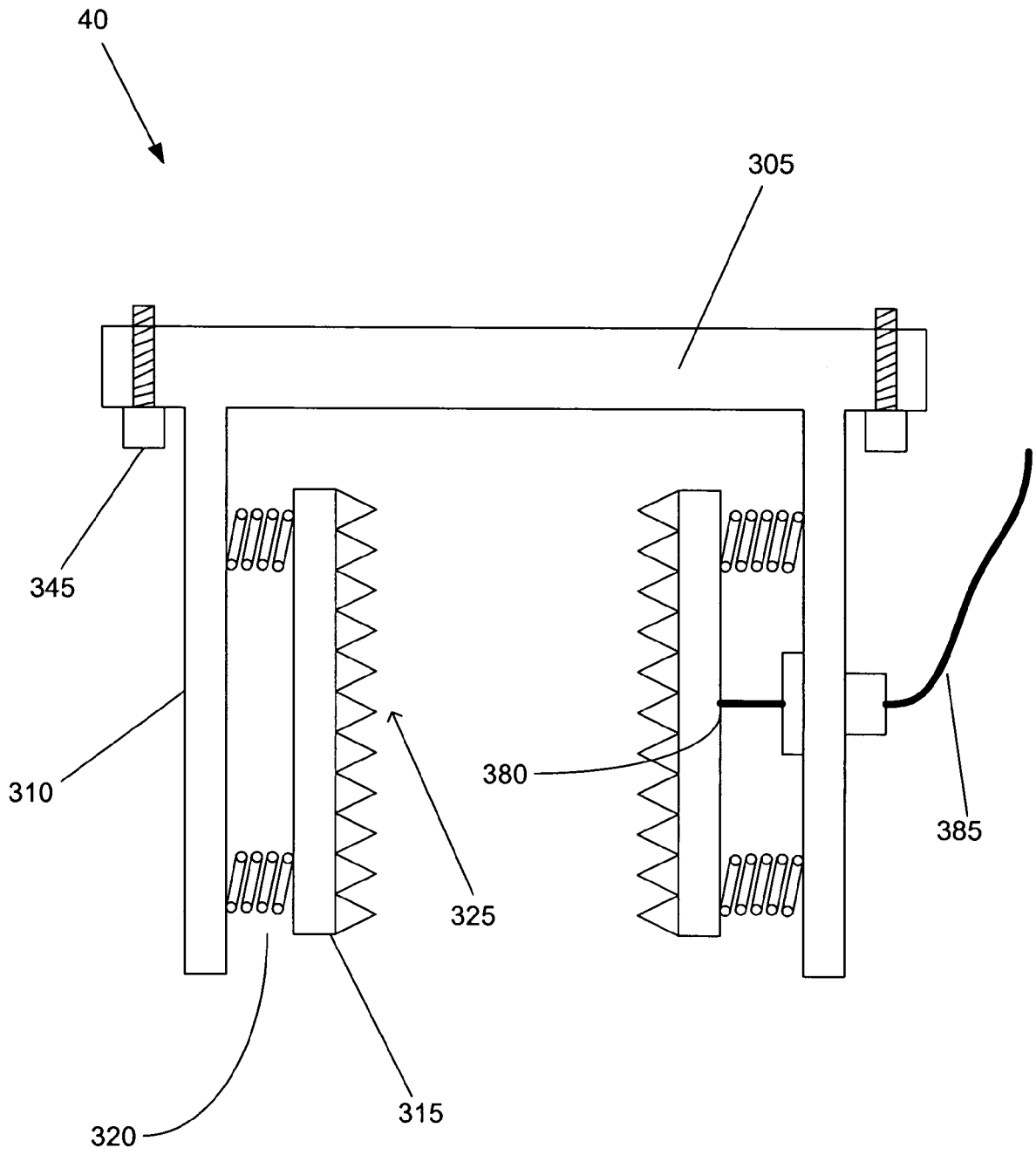
FIG. 6 is a side perspective of one preferred embodiment of the stake-gripping device.

FIG. 6 is a side perspective of stake-gripping device 40. The device comprises a housing 305 that attached to housing 205 of the vibrating mechanism 30 via bolts 345. The lower portion of housing 305 has a square or rectangular cross-section and an opening 350 for inserting a stake or post. A pair of stake gripping plates 315 are mounted on opposing internal walls of housing 305. The gripping plates have a toothed or serrated surface 325 to firm grip a stake or post. The gripping plates are attached to the internal walls of housing 305 with springs 320, which may be standard coil springs, torsion springs, or any other type of spring, to allow varying positions of gripping plates 315 to permit the insertion of stakes or posts with varying dimensions. In one preferred embodiment, the housing 315 is of sufficient size to accept a stake constructed of a standard 2×4 timber.

As shown in FIG. 6, at least one plate 315 is attached to a wire 385, which is coupled to the handle 75 on frame 60 (shown in FIG. 1). The wire operates similar to a standard throttling cable, such that when the handle 75 is depressed, the wire pulls plate 315 and compresses springs 320. This arrangement allows the gripping plates 315 to be opened for insertion of a stake or post. Alternatively, both gripping plates 315 can be attached to the internal wall of housing 305 along with a wire 385, which are both routed to handle 75 on frame 60.

Gripping plates 315 are shown as planar members in FIG. 6. Alternatively, gripping plates 315 may be shaped to accept stakes and posts of various shapes. For example, plates having a concave gripping surface forming a semi-cylindrical space may be employed when driving and extracting stakes or posts having a circular cross-section.

Although the present invention has been described in terms of specific embodiments, it is anticipated that alterations and modifications thereof will no doubt become apparent to those skilled in the art. It is therefore intended that the following claims be interpreted as covering all alterations and modifications that fall within the true spirit and scope of the invention.

The invention claimed is:

1. A hand-held vibratory apparatus for driving and extracting a stake, the apparatus comprising:

a motor having a shaft;

a vibrational energy generating means coupled to the shaft and powered by the motor;

a stake-holding means connected to the vibrational energy generating means such that vibrational energy generated by the vibrational energy generating means is transferred to a stake through the stake-holding means, wherein the stake-holding means further comprises a gripping device enclosed within a housing, the housing having an opening at bottom end for the insertion of a stake, the gripping device comprising a pair of opposed planar members coupled to the housing, the planar members capable of being positioned to hold a stake, wherein at least one planar member is coupled to the housing via springs, and wherein the positioning of at least one planar member is controlled by a wire such that as the wire is pulled the planar member is pulled against the springs thereby compressing the springs; and a frame assembly from which the motor, the vibrational energy generating means, and the stake-holding means are suspended, the frame assembly having a pair of handles for holding and operating the hand-held vibratory apparatus.

2. The apparatus of claim 1, wherein the vibrational energy generating means comprises a vibration mechanism enclosed within a housing, the vibration mechanism comprising a motor gear coupled to the shaft, a plurality of plates wherein the plates have a center of mass away from the plates' axis of rotation, the plurality of plates having a gear teeth portion mechanically engaging the motor gear such that as the motor gear rotates so do the plurality of plates, the plurality of plates mechanically coupled to the housing such that the plurality of plates are allowed to spin freely as the motor gear turns.

3. The apparatus of claim 2, wherein the plurality of plates further comprises an eccentric portion connected to the gear teeth portion, such that the eccentric portion moves the center of mass of the plate away from the axis of rotation.

4. The apparatus of claim 2, wherein the plurality of plates further comprises a concentric portion connected to the gear teeth portion and a weighted member connected to the concentric portion, such that the weighted member moves the center of mass of the plate away from the axis of rotation.

5. The apparatus of claim 1, wherein the surface of the planar member contacting a stake has a roughed surface to increase friction and improve grip on a stake.

6. The apparatus of claim 5, wherein the surface of the planar member contacting the stake has a plurality of teeth to grip a stake.

7. The apparatus of claim 1, wherein the frame assembly comprises an upper section surrounding and protecting the motor and a lower section comprising a plurality of support members, the support members connecting the upper section of the frame assembly to the vibrational energy generating means.

8. The apparatus of claim 7, wherein the handles of the frame assembly further comprise controls for throttling the motor and actuating the stake holding means.

9. The apparatus of claim 8, wherein the vibrational energy generating means comprises a vibration mechanism enclosed within a housing, the vibration mechanism comprising a motor gear coupled to the shaft, a plurality of plates wherein the plates have a center of mass away from the plates' axis of rotation, the plurality of plates having a gear teeth portion mechanically engaging the motor gear such that as the motor gear rotates so do the plurality of plates, the plurality of plates mechanically coupled to the housing such that the plurality of plates are allowed to spin freely as the motor gear turns.

10. The apparatus of claim 9, wherein the plurality of plates further comprises an eccentric portion connected to the gear teeth portion, such that the eccentric portion moves the center of mass of the plate away from the axis of rotation.

11. The apparatus of claim 9, wherein the plurality of plates further comprises a concentric portion connected to the gear teeth portion and a weighted member connected to the concentric portion, such that the weighted member moves the center of mass of the plate away from the axis of rotation.

* * * * *